US005216953A

United States Patent [19]

Hada

[11] Patent Number: 5,216,953

[45] Date of Patent: Jun. 8, 1993

[54] PRINTING CYLINDER

[75] Inventor: Kazuyuki Hada, Tokuyama, Japan

[73] Assignee: Tokuyama Soda Kabushiki Kaisha, Tokuyama, Japan

[21] Appl. No.: 895,660

[22] Filed: Jun. 9, 1992

[30] Foreign Application Priority Data

Jun. 10, 1991 [JP] Japan ..... 3-43117[U]

[51] Int. Cl.[5] ..... B41F 13/10

[52] U.S. Cl. ..... 101/375; 101/423; 101/389.1; 101/425

[58] Field of Search ..... 101/375, 389.1, 384, 101/382.1, 378, 368, 216, 376, 425, 423; 29/119, 123, 125, 110, DIG. 105

[56] References Cited

U.S. PATENT DOCUMENTS 3,668,752 6/1972 Clifton et al. ..... 29/124
4,864,704 9/1989 Hogan et al. ..... 29/119
4,914,478 4/1990 Yashiki ..... 29/123

FOREIGN PATENT DOCUMENTS 0017233 10/1980 European Pat. Off. .
2243832 9/1974 France .
2005193 4/1979 United Kingdom .

*Primary Examiner*—Edgar S. Burr
*Assistant Examiner*—Anthony H. Nguyen
*Attorney, Agent, or Firm*—Sherman and Shalloway

[57] ABSTRACT

A printing cylinder is disclosed which makes it possible to remove the ink adhering to the side surfaces of the printing cylinder after the printing has been finished without the need of moving the printing cylinder.

16 Claims, 7 Drawing Sheets

PRINTING CYLINDER

BACKGROUND OF THE INVENTION

A printing method has been put into practice in which a printing ink is fed onto the printing face constituted by the outer surface of a printing cylinder of a cylindrical shape (hereinafter simply referred to as printing cylinder), the printing cylinder is set to a printing press and is rotated in order to print the papers, as is done, for example, in gravure printing.

In the above-mentioned printing method using the printing cylinder, the ink adhering to the printing face of the printing cylinder is wiped off after the printing is finished. The ink layer adhering to the side surfaces of the printing cylinder usually becomes as thick as ten and several millimeters at a moment when the printing is finished. The ink adhering to the side surfaces of the printing cylinder cannot be automatically removed because the printing cylinder is heavy and that the ink is not adhered uniformly. If the ink that is adhered is not wiped off, then it mixes into the ink used in the next printing, causing the ink to lose its color tone. Furthermore, the ink that is coagulated peels off at the time of printing and adheres to the surface of the printing cylinder causing the doctor blade to be damaged and hindering the printing.

In order to solve the problem caused by the ink that is adhered to the side surfaces of the printing cylinder, a method has been disclosed in Japanese Laid-Open Patent Publication No. 91281/1987 in which the printing cylinder is removed from the printing press and the side surfaces thereof are cleaned. That is, the printing cylinder having ink adhered to the side surfaces thereof is removed from the printing press, and the water is sprayed under very high pressure against the printing cylinder.

According to the above method, however, it is necessary to clean the side surfaces of the printing cylinder in addition to the operation for wiping the ink off the printing face of the printing cylinder that is removed from the printing press; i.e., a great deal of labor is required to move the very heavy printing cylinder to the cleaning device which sprays water under a very high pressure. Moreover, there is a likelihood of damaging the printing face of the printing cylinder while it is being moved or during the operation for washing out the ink.

Japanese Utility Model Laid-Open Publication No. 93236/1986 proposes a printing cylinder which prevents the ink from adhering onto the side surfaces by providing the side surfaces of the printing cylinder with a layer of a fluorine-resin such as polytetrafluoroethylene. This makes it possible to considerably reduce the amount of ink adhering to the side surfaces of the printing cylinder making, however, it necessary to remove the ink adhered to the side surfaces in addition to the operation for wiping the ink off the printing face of the printing cylinder. Like the above-mentioned method, therefore, it is necessary to clean the side surfaces of the printing cylinder leaving such problems as the introduction of a cleaning step and the likelihood of damaging the printing cylinder while it is being moved for the purpose of being cleaned.

OBJECTS OF THE INVENTION

The object of the present invention is to provide a printing cylinder which makes it possible to remove the ink adhered to the side surfaces of the printing cylinder after the printing has been finished without the need of moving the printing cylinder.

Another object of the present invention is to provide a printing cylinder which makes it possible to efficiently clean the side surfaces thereof even under the condition where the printing cylinder is being mounted on the printing press.

SUMMARY OF THE INVENTION

The above objects of the present invention are accomplished by removable annular side plates which are attached to the side surfaces of the body of the printing cylinder utilizing magnetic force. The annular side plates have a circumference close to the circumference of the side surfaces of the body of the printing cylinder.

The present invention will now be described in further detail in conjunction with the drawing that illustrate preferred embodiments of the printing cylinder constituted according to the invention.

DESCRIPTION OF THE PREFERRED EMBODIMENTS

Figure 1:
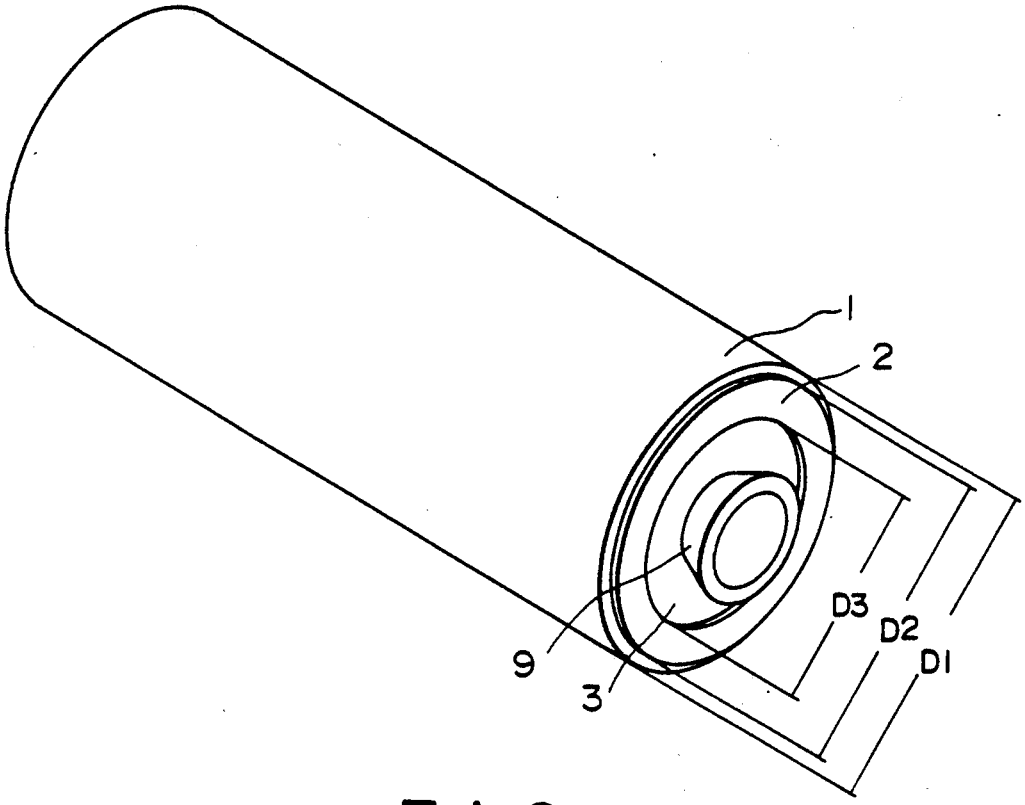
FIGS. 1, 1A, 2, 3, 4 and 4A–4D are perspective views illustrating various representative embodiments of the printing cylinder according to the present invention.
Figure 1A:
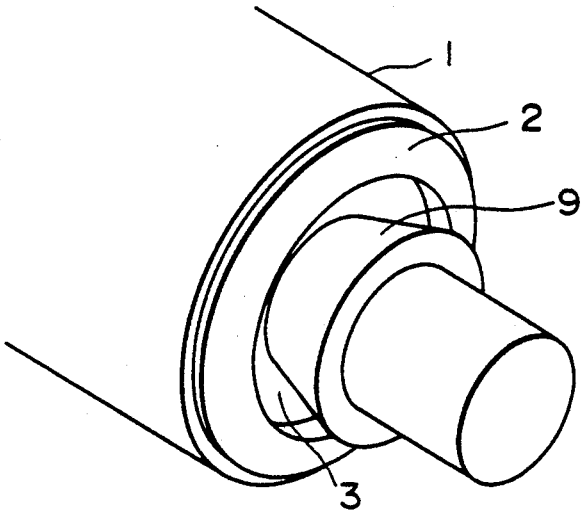

The structure of the body of the printing cylinder of the present invention will now be described in conjunction with FIG. 1. In the present invention, a widely known structure comprising a cylindrical drum constituting the printing face and members constituting side surfaces 3, is employed as a body 1 of the printing cylinder 19 without any particular limitation. There is no particular limitation with regard to the materials, either. Widely known materials such as steel, an aluminum alloy, etc., are generally used. drum and the side surfaces of the body of the printing cylinder 19 may be made of the same material or different material. for example, the whole printing cylinder 19 may be made of a steel or the drum of the printing cylinder 19 may be made of an aluminum alloy and the side surfaces may be made of steel. Furthermore, the body 1 of the printing cylinder 19 has a mechanism at the center of both side surfaces thereof that couples to the rotary shaft of a printing press. For instance, the rotary shaft of the printing press ma be secured to the centers of side surfaces 3 of the body 1 of the printing cylinder 19 as a unitary structure. Alternatively, bores for fixing the rotary shaft may be formed at the centers of the side surfaces 3, without any particular limitation. The embodiment shown in FIG. 1 deals with the structure in which bores are formed to fix the rotary shaft. In this case, it is desired to provide the bore with a cylindrical cone 9 which spreads outwardly to facilitate the mounting of the rotary shaft on the printing press.

When the side surfaces 3 are not made of a ferromagnetic substance such as steel, the side surfaces 3 are provided with a layer of a ferromagnetic substance or with a layer which serves as a permanent magnet, using a fixing means such as screws or the like.

Depending upon the mode of printing, furthermore, there is formed a metal-plated layer or a rubber layer for forming a printing plate on the drum of the body 1 of the printing cylinder 19.

According to the present invention, removable annular side plates 2 are attached to both side surfaces 3 of the printing cylinder 19 utilizing the magnetic force to cover the side surfaces. There is no particular limitation to the size of the annular side plates 2 provided they have an outer diameter D2 which is close to the outer diameter D1 of the body 1 of the printing cylinder 19. In general, the outer diameter D2 of the annular side plates 2 should desirably lie over a range from the outer diameter D1 of side surfaces 3 of the body 1 of the printing cylinder 19 to a diameter which is smaller by 20 mm than the outer diameter D1. In the case of the structure in which the rotary shaft is fixed to the printing cylinder 19, the bore diameter D3 of the annular side plates 2 should be smaller than the outer diameter D2 of the side plates 2 but should be greater than the outer diameter of the rotary shaft. In the case of the structure where bores are provided to insert the rotary shaft in the printing cylinder 19 as shown in FIG. 1, the bore diameter D3 should be smaller than the outer diameter of the side plates 2. When the bore is provided with the cone 9 to receive the rotary shaft, furthermore, the bore diameter D3 of the annular side plates 2 should be greater than the outer diameter of the cone 9. The annular side plates 2 should desirably be so designed as to partly cover the outer circumferential portion of the side surfaces 3 as shown in FIG. 1 from the standpoint of facilitating the operation for attaching and detaching the annular side plates 2, reducing the weight, and enhancing the effect of preventing the ink from adhering onto the side surfaces 3 of the body 1 of the printing cylinder 19 despite an increase, in the areas that are covered. It is preferable that difference between the outer diameter D2 of the annular side plates 2 thereof and the bore diameter D3 thereof is from 10 to 60% with respect to the outer diameter D1 of the printing cylinder 19.

It is further desired that the annular side plates 2 have a small thickness to reduce the weight thereof. However, too small a thickness is accompanied by a reduction in the mechanical strength which may result in the breakage when the annular side plates 2 are being attached to or detached from the side surfaces 3 of the body 1 of the printing cylinder. Therefore, a suitable thickness should be determined by taking the reduction in weight and the mechanical strength into consideration. Usually, the thickness ranges from 0.5 to 10 mm.

As shown in FIG. 1-A, the annular side plates 2 may have a tapered outer surface whose thickness increases from the outer circumference toward the inner circumference.

There is no particular limitation in the embodiment of detachably attaching the annular side plates 2 to the side surfaces 3 of the printing cylinder 19 by utilizing a magnetic force provided the side plates 3 can be held on the side surfaces 2 of the printing cylinder 19 by the magnetic force. In general, the side surfaces 3 of the body 1 of the printing cylinder 19 are made from a ferromagnetic substance and the annular side plates 2 are partly or entirely made from by a permanent magnet, or, alternatively, the side surfaces 3 of the body 1 of the printing cylinder 19 are made from a permanent magnet and the annular side plates 2 are partly or entirely made from a ferromagnetic substance.

Any widely known material can be used as the ferromagnetic material without any particular limitation, provided it is magnetized and is attracted by the magnetic field of a permanent magnet. Examples include such metals as iron, cobalt, nickel, etc. Moreover, any permanent magnet may be used without any particular limitation. Examples include carbon steel, tungsten steel, KS-steel, Alnico, etc. The above ferromagnetic substance and permanent magnet may be used in their own form or may be used in the form of a so-called "plastic magnet" by pulverizing them and mixing them in a matrix of a resin or a rubber.

The side plates 2 which are held on the side surfaces 3 of the printing cylinder 19 by the magnetic force may begin to be deviated from the side surfaces 3 if they are too heavy due to the centrifugal force produced during the printing operation by the rotation of the printing cylinder 19.

Figure 5:
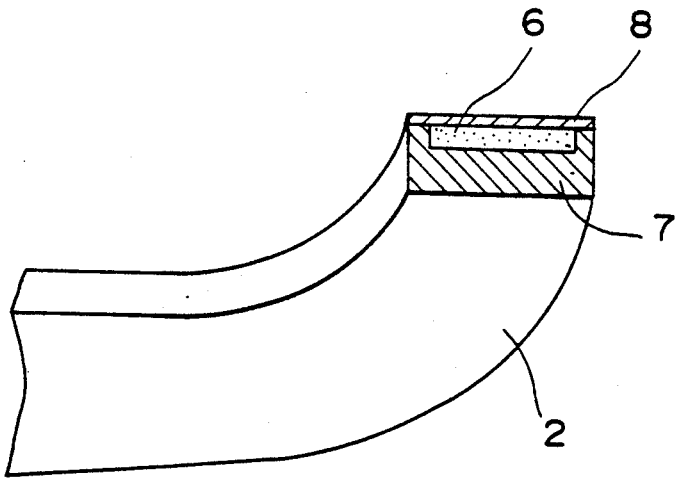
FIG. 5 is a sectional view illustrating the internal structure of the annular side plate provided on the side surfaces of the printing cylinder according to a representative embodiment of the present invention.

According to the present invention therefore, though the annular side plates 2 can be made entirely of a permanent magnet (including plastic magnet) or comprised of a the ferromagnetic substance, it is desired to partly use the permanent magnet or the ferromagnetic substance depending upon the intensity of magnetic force of the permanent magnet with a light material such as a thermoplastic resin, e.g., polyolefin resin, polyvinyl chloride resin or the like resin, in order to reduce the weight of the side plates 2 covering the side surfaces 3 of the printing cylinder 19. FIG. 5 is a sectional view illustrating the internal structure of the annular side plate 2 which partly employs the permanent magnet according to a representative embodiment. In FIG. 5, the side plate 2 is formed in an annular shape and has a thermoplastic resin film 8 laminated on one surface of the permanent magnet 6 (inclusive of a plastic magnet) and a thermoplastic resin 7 molded on the other surface thereof. According to this embodiment, the thermoplastic resin film 8 having a small thickness is formed on one side of the permanent magnet 6. Therefore, if the side of the magnet 6 in contact with the resin film 8 is facing is the side surface 3 of the printing cylinder, the magnetic force of the side plate 2 is not lost with respect to the above side.

The present invention also provides a printing cylinder 19 employing the above-mentioned annular side plates 2 capable of being opened and attached to or detached from the body of the printing cylinder when the body of the printing cylinder is mounted on the printing press. The annular side plate shown in FIG. 1 is continuous throughout the whole circumference and must be attached thereto or detached therefrom by removing the printing cylinder from the printing press. On the other hand, the annular side plates in the present invention are capable of being opened to attach to and detach from the printing cylinder by opening them when the printing cylinder 19 is mounted on the printing press, making it possible to carry out the operation more efficiently.

Figure 4:
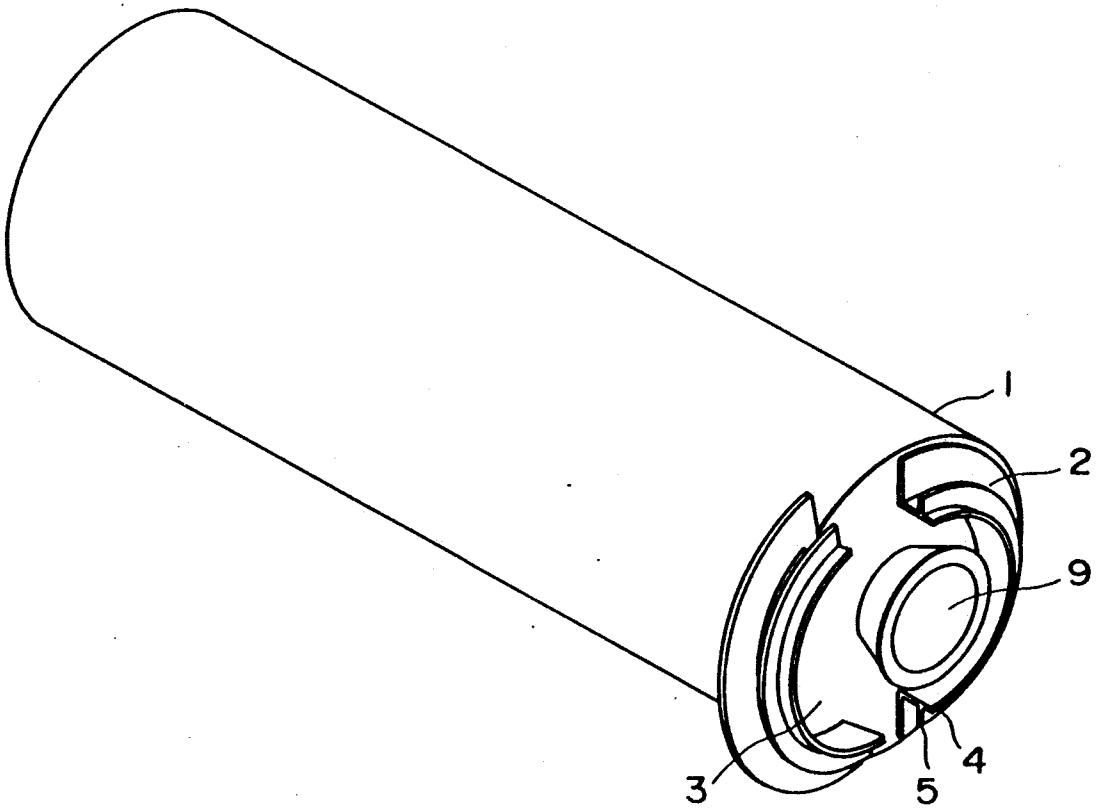
Figure 4A:
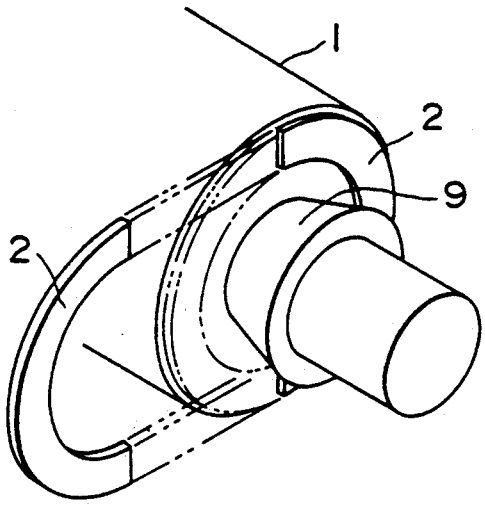
Figure 4B:
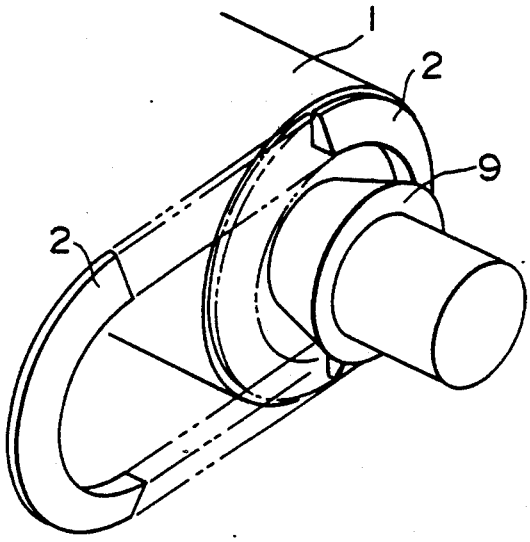
Figure 4C:
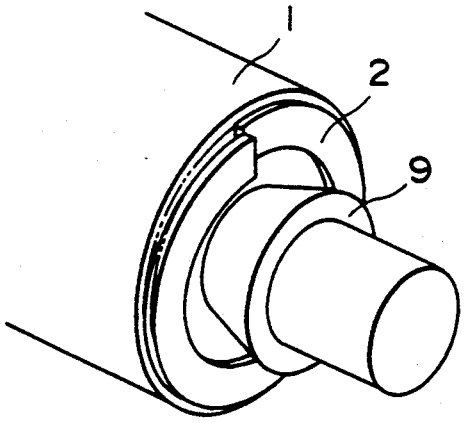
Figure 4D:
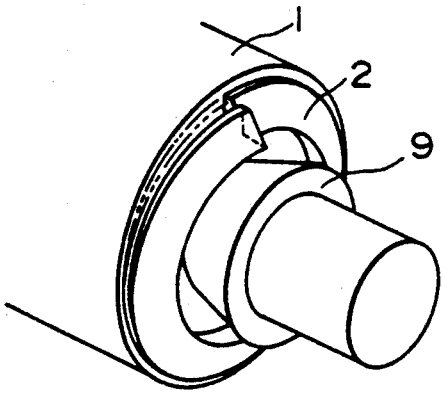

The annular side plate can be formed in a manner to be split or cut at only one section so that it can be opened. As shown in FIGS. 4, 4-A and 4-B, the annular side plate 2 can be split into two or ore segments.

As shown in FIGS. 4-C and 4-D, furthermore, the annular side plate 2 can be opened by cutting only one portion thereof, provided it has flexibility.

Figure 2:
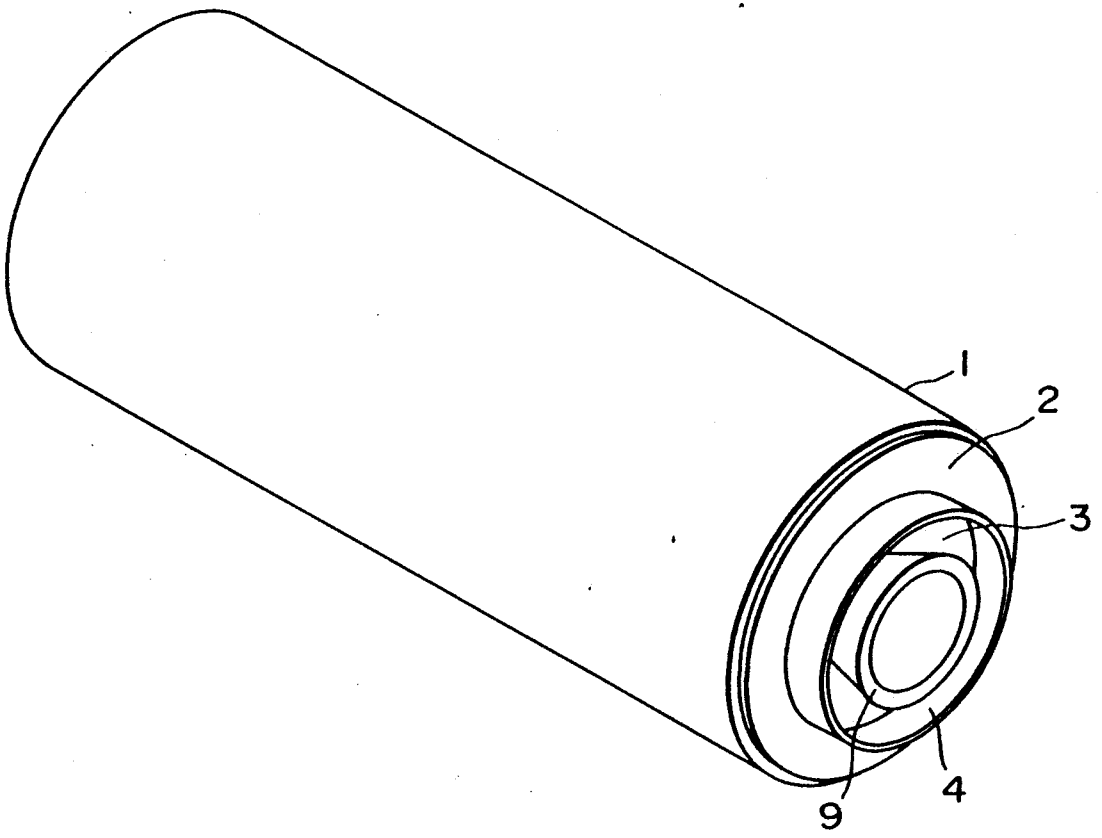

In order to prevent the ink adhered to the side surfaces of the body 1 of the printing cylinder from moving in the direction of the rotary shaft according to the present invention as shown in FIG. 2, it is desired to provide a continuous protrusion 4 along the inner circumference on the surface of the annular side plate 2 opposite to the surface that comes in contact with the side surface of the printing cylinder 19. Though there is no particular limitation, the protrusion usually has a height of about 2 to 50 mm.

Figure 3:
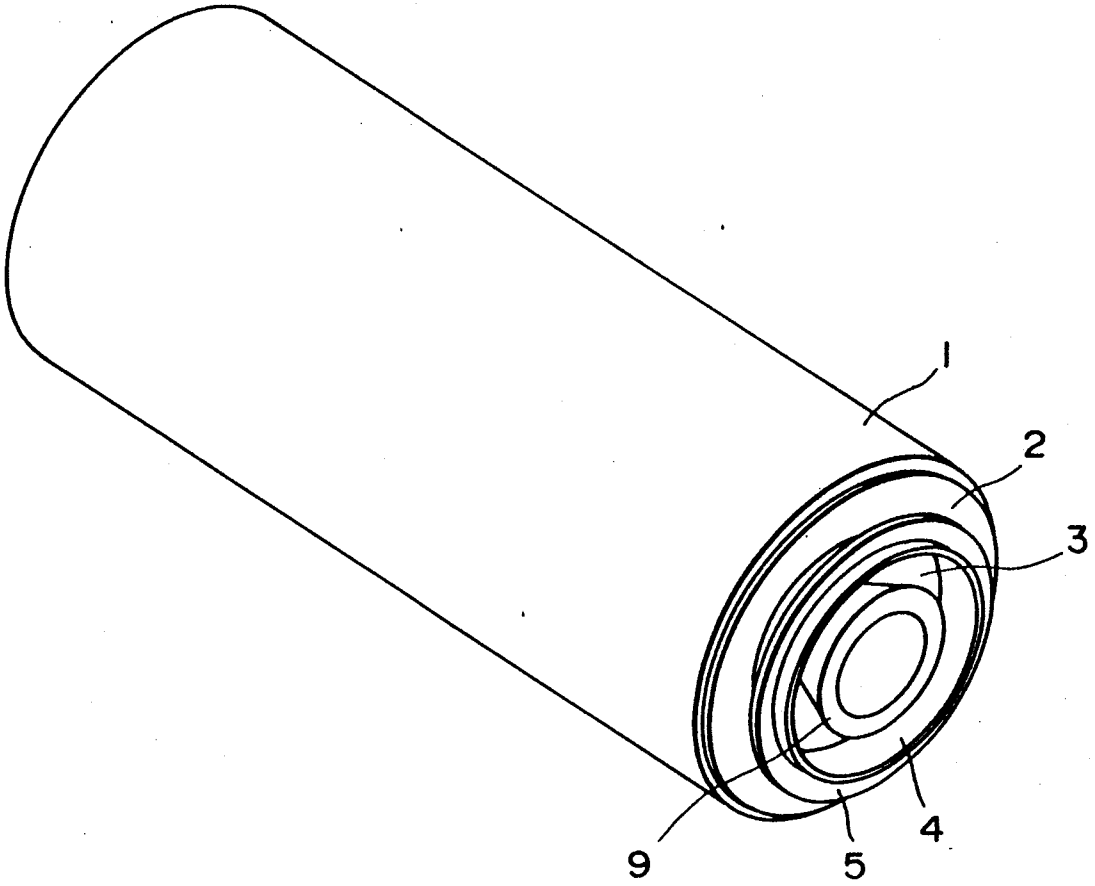

According to the present invention as shown in FIG. 3 or 4, furthermore, it is desired to provide a flange 5 along the outer circumference of the protrusion 4 in order to further increase the effect of the protrusion 4 that is shown in FIG. 2. The flange usually has a width of from 1 mm to several mm.

According to the embodiment in which the protrusion is provided along the inner circumference of the side plate as shown in FIGS. 2 to 4, it is desirable to decrease the width of the annular side plate 2 and to reduce the weight thereof.

According to the present invention, it is desired that the annular side plate 2 has at least the surface thereof composed of a material on which the ink adheres sparingly. Examples of such a material include polyamide, polypropylene, polyethylene, fluorine-resin, silicone resin, and like resins.

The printing cylinder 19 of the present invention is mounted on the printing press by a known method without any particular limitation. For instance, the body 1 of the printing cylinder 19 having a rotary shaft fixed thereto is used with its rotary shaft being held by the bearings of the rotary device of he printing press. The body 1 of the printing cylinder 19 having bores for fixing the rotary shaft thereto is used with its rotary shaft fixed to the bores and held by the bearings of the rotary device of the printing press. Or, the printing cylinder 19 is used by pressing the rotary shaft interlocked to the rotary device to the cones 9 fitted to the bores on both sides of the printing cylinder 19.

Figure 6:
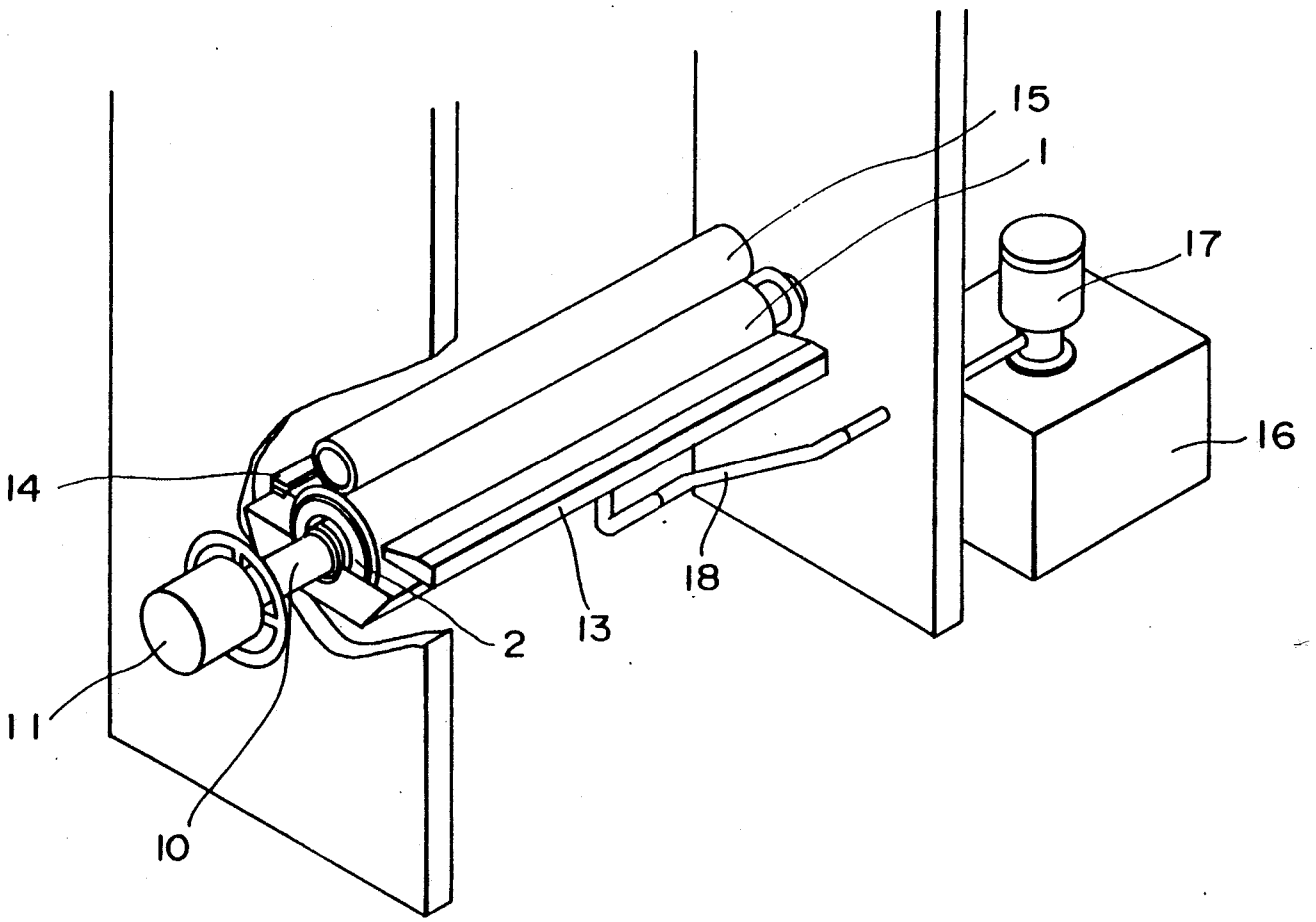
FIG. 6 is a perspective view illustrating the condition where the printing cylinder of the present invention is mounted on printing press.

FIG. 6 is a perspective view illustrating the major structure of the printing unit of a gravure printing press wherein a rotary shaft 10 interlocked to the rotary device is pressed by a fastening device 11 onto the cones 9 fitted to the bores on both sides of the printing cylinder 19 of the embodiment shown in FIG. 1 thereby to fix the printing cylinder. In FIG. 6, reference numeral 12 denotes an ink pan, 13 denotes an applicator, 14 denotes a doctor blade, 15 denotes a back-up roller, 16 denotes an ink tank, 17 denotes an ink feeding pump, and reference numeral 18 denotes an ink feeding pipe.

According to the present invention, usually, the printing cylinder 19 is removed from the printing press after the printing is finished, and the annular side plates 2 are replaced before or after the ink is wiped off the printing face. Alternatively, the annular side plates 2 of the structure capable of being opened can be replaced by the new ones without the need of removing the printing cylinder 19 from the printing press.

The used side plates 2 may be discarded away but are usually cleaned and used again for the printing cylinder 19.

The above side plates 2 can be easily cleaned compared with the case of directly cleaning the side surfaces 3 of the printing cylinder 19 because there is no need to remove the printing cylinder 19. Furthermore, it is more difficult to automatically clean the side surfaces 3 of the printing cylinder 19. However, the annular side plates 2 which have been removed from the side surfaces 3 of the printing cylinder 19 can be cleaned in the cleaning tank easily and automatically.

The printing cylinder 19 of the present invention can be adapted not only to the gravure printing press but also to any other widely known printing presses that use the printing cylinder.

According to the printing cylinder of the present invention, the annular side plates 2 are detachably attached to the body 1 of the printing cylinder 19 utilizing a magnetic force. Therefore, the side plates 2 can be easily attached utilizing the magnetic force prior to the printing operation and can be easily detached after the printing operation is finished while the ink is being wiped off the printing face. Moreover, the side surfaces 3 of the printing cylinder 19 have been covered with the annular side plates 2 during the printing operation and need not be cleaned after the side plates are taken out; i.e., attaching the new annular side plates is all that it takes to prepare the printing cylinder of the present invention again for use in the printing operation.

Therefore, no operation, is required for moving the printing cylinder 19 through other processing steps for removing the ink adhered on the side surfaces 3, and there arises no problem of damaging to the printing cylinder. Moreover, the time for removing the ink adhered on the side surfaces can be shortened by more than 90% compared with the conventional method of removing the ink adhering on the side surfaces 3 by cleaning after the ink has been wiped off the printing cylinder.

In particular, the annular side plates 2 capable of being opened, i.e., the annular side plates 2 split into a plurality of segments or having flexibility and cut at one portion, can be replaced without the need of removing the printing cylinder 19 from the printing press to further enhance the above-mentioned effects.

The annular side plates 2 detached from the side surfaces 3 of the printing cylinder can be cleaned for being used repetitively, i.e., can be cleaned in a step separate from the printing step. A known automatic cleaning system can be employed for for greater.

EXAMPLES

EXAMPLE 1

The printing cylinder shown in FIG. 3 was constructed. Annular side plates made of a plastic magnet having an outer diameter D2 of 290 mm, a bore diameter D3 of 190 mm, a protrusion with a height of 30 mm, and a flange with a width of 20 mm and a thickness of 3 mm, were magnetically attached to both side surfaces of a body of the printing cylinder made of a steel having an outer diameter D1 of 290 mm.

The printing cylinder was mounted on a gravure printing press shown in FIG. 6, and the printing was carried out under the following conditions.

| | |
|---|---|
| Line speed | 200 mm/min. |
| Number of revolutions of the printing cylinder | 219.6 rpm |
| Printing time | 30 min. |
| Type of ink | rubber-type ink for gravure printing |

The annular side plates practically did not deviate from the body of the printing cylinder during the printing operation.

After the printing operation, the printing cylinder was removed from the printing press, and the annular side plates were detached from the body of the printing press, and the annular side plates were detached from the body of the printing cylinder with ease. The ink did not adhere at all to the side surfaces of the main body of the printing cylinder or to the rotary shaft.

The ink was wiped off the printing face, and the new annular side plates were attached to the side surfaces of the body of the printing cylinder which was then mounted on the printing press in order to carry out the printing in the same manner as described above.

The annular side plates detached from the printing cylinder were dipped in methylene chloride. The adhered ink was completely removed, and the annular side plates could be used again.

The aforementioned attachment of the annular side plates to the body of the printing cylinder, printing operation, wiping of the ink, detachment of the annular side plates, and cleaning operation, were repeated 50 times by changing the ink color each time. However, there was no reduction in the magnetic force of the annular side plates and no discoloration, either, due to inks used before and after the printing.

EXAMPLE 2

The annular side plates were attached to the body of the printing cylinder, the printing as carried out, the ink was wiped off, the annular side plates were detached, and the cleaning operation was carried out in the same manner as in the example 1 with the exception of using annular side plates having an outer diameter D2 of 290 mm, a bore diameter D3 of 190 mm and a thickness of 3.3 mm. The side plates possessed the internal structure shown in FIG. 5. That is, the plastic magnet having a width of 35 mm and a thickness of 2.1 mm was held between a polypropylene film having a thickness of 100 um and a polypropylene resin mold.

The annular side plates practically did not deviate from the body of the printing cylinder during the printing operation.

After the printing operation, the printing cylinder was removed from the printing press, and the annular side plates 2 were detached from the body 1 of the printing cylinder with ease. The ink did not adhere at all the side surfaces of the main body of the printing cylinder or to the rotary shaft.

The annular side plates detached from the printing cylinder were dipped in methylene chloride. The adhered ink was completely removed, and the annular side plates could be used again.

Even after the experiment, there was no reduction in the magnetic force of the annular side plates and no discoloration, either, due to inks used before and after the printing.

EXAMPLE 3

The printing was carried out using the same printing press as that of the example 2 but changing the annular side plates 2 into those having an outer diameter D2 of 290 mm, a bore diameter D3 of 190 mm and a thickness of 3.3 mm, and having a cut at one portion thereof as shown in FIG. 1. The side plates possessed the internal structure as shown in FIG. 5. That is, a plastic magnet having a width of 35 mm and a thickness of 2.1 mm was held between the polypropylene film 8 having a thickness of 100 um and a polypropylene resin mold.

The body of the printing cylinder was mounted on the gravure printing press shown in FIG. 6, and the annular side plates 2 were fitted through their cut portions to the rotary shaft and were magnetically attached to the side surfaces of the body of the printing cylinder.

The annular side plates practically did not deviate from the body of the printing cylinder during the printing operation.

After the printing operation, the annular side plates 2 could be detached from the body 1 of the printing cylinder without the need of removing the printing cylinder from the printing press. The ink did not adhere at all to the side surfaces of the body of the printing cylinder or to the rotary shaft.

The ink could be wiped off the printing face and the new annular side plates could be attached under the condition where the body of the printing cylinder was being mounted on the printing press.

The annular side plates detached from the printing cylinder were dipped in methylene chloride. The adhered ink was completely removed, and the annular side plates could be used again.

The aforementioned attachment of the annular side plates to the body of the printing cylinder, printing operation, wiping of the ink, detachment of the annular side plates and cleaning operation, was repeated 50 times by changing the ink color each time. However, there was no reduction in the magnetic force of the annular side plates and no discoloration, either, due to inks used before and after the printing.

EXAMPLE 4

The procedure was carried out in the same manner as in the example 3 but using the annular side plates that are split into two as shown in FIG. 4 instead of the annular side plates used in example 1.

The annular side plates practically did not deviate from the body of the printing cylinder during the printing operation.

The annular side plates could be attached to and detached from the body of the printing cylinder without the need of removing the body of the printing cylinder from the printing press. The ink did not adhere at all to the side surfaces or the main body of the printing cylinder or to the rotary shaft.

The annular side plates detached from the printing cylinder were dipped in methylene chloride. The adhered ink was completely removed, and the annular side plates could be used again.

The aforementioned attachment of the annular side plates to the body of the printing cylinder, printing operation, wiping of the ink, detachment of the annular side plates and cleaning operation, was repeated 50 times by changing the ink color each time. However, there was no reduction in the magnetic force of the annular side plates and no discoloration, either, due to inks used before and after the printing.

I claim:

1. A printing cylinder having a body, opposite end side surfaces, and means to enable easy cleaning of ink which adheres onto said opposite end side surfaces, said means including annular side plates, said annular side plates having an outer circumference close to the circumference of the body of said cylinder, said annular side plates being detachable retained on said opposite end side surfaces by magnetic force whereby ink adhering onto opposite end side surfaces is collected by said side plates, and said annular side plates are easily removed from, cleaned and returned to said opposite end side surfaces.

2. The printing cylinder according to claim 1, wherein the annular side plates have an outer diameter ranging from equal to the outer diameter of the side surfaces to 20 mm smaller than the outer diameter of the side surfaces.

3. The printing cylinder to claim 1, wherein the annular side plates have an outer diameter equal to the outer diameter of the side surfaces.

4. The printing cylinder according to claim 1, wherein each of the opposite end side surfaces comprises a ferromagnetic substance, and each of said annular side plates compresses a permanent magnet.

5. The printing cylinder according to claim 4, wherein each of said annular side plates further comprises a thermoplastic polymer encasing said permanent magnet.

6. The printing cylinder according to claim 5, wherein said annular plates have an inner face facing said side surface, wherein said permanent magnet of each of said annular side plates is encased in said thermoplastic polymer such that each said inner face of each of said annular side plates has a thin covering of said thermoplastic polymer encasing said permanent magnet.

7. The printing cylinder according to claim 1, wherein the opposite end side surfaces each comprises a permanent magnet, and the annular side plates each comprises a ferromagnetic substance.

8. The printing cylinder according to claim 4, wherein said annular side plates further comprise a thermoplastic resin film laminated to the surface of said annular side plates facing said end side surface of the printing cylinder, and a molded layer of thermoplastic resin covering the other surface of said annular side plates.

9. The printing cylinder according to claim 1, wherein each said annular side plate has at least one split from the outer circumference thereof to the inner circumference thereof, wherein said annular side plates may be opened and closed to facilitate removal and attachment of said annular plates to and from said side surfaces.

10. The printing cylinder according to claim 9, wherein said annular side plates are each comprised of at least two segments.

11. The printing cylinder according to claim 9, wherein said annular side plates have a single split and are flexible.

12. The printing cylinder according to claim 1, wherein said annular side plates each further comprise a continuous ring shaped protrusion along the inner circumference of the annular side plates and extending outwardly form the surface of said annular side plate remote from said end side surface.

13. The printing cylinder according to claim 12, wherein said protrusion has a height of between about 2 to 50 mm.

14. The printing cylinder according to claim 12, wherein said annular side plates each further comprise a continuous ring shaped flange extending outwardly from the outer surface of the ring shaped protrusion.

15. The printing cylinder according to claim 1, wherein the thickness of said annular side plates increases from the outer circumference thereof to the inner circumference thereof.

16. The printing cylinder according to claim 1, wherein at least the surface of each of said annular side plates remote from said end side surfaces comprises a material selected from the group consisting of a polyamide, a polypropylene, polyethylene, a fluorine resin, and a silicone resin.

* * * * *